United States Patent [19]

Hickman

[11] Patent Number: 4,692,744

[45] Date of Patent: Sep. 8, 1987

[54] GLAZING UNIT ALARM SYSTEMS

[76] Inventor: James A. A. Hickman, 14a Seaforth Drive, Edinburgh, Scotland

[21] Appl. No.: 815,586

[22] Filed: Jan. 2, 1986

[30] Foreign Application Priority Data

Jan. 4, 1985 [GB] United Kingdom ..... 8500203

[51] Int. Cl.[4] ..... G08B 13/00

[52] U.S. Cl. ..... 340/550; 340/590; 340/598; 340/652; 200/61.08; 109/5; 109/21; 52/782; 52/788; 52/791; 126/419; 47/17; 427/126.3

[58] Field of Search ..... 340/550, 590, 598, 652; 200/61.08; 109/5, 21; 52/782, 788, 789, 791; 126/419, 422; 47/17; 427/126.3; 338/15, 19, 226

[56] References Cited

U.S. PATENT DOCUMENTS

| | | | |
|---|---|---|---|
| 3,825,918 | 7/1974 | Laidlaw, Jr. et al. | 340/550 |
| 3,825,919 | 7/1974 | Levin et al. | 340/550 |
| 3,947,837 | 3/1976 | Bitterice | 340/550 |
| 4,598,274 | 7/1986 | Holmes | 340/550 |

FOREIGN PATENT DOCUMENTS

| | | |
|---|---|---|
| 2844018 | 4/1980 | Fed. Rep. of Germany . |
| 2308148 | 11/1976 | France . |
| WO83/01018 | 3/1983 | PCT Int'l Appl. . |
| 1119539 | 7/1968 | United Kingdom . |
| 1193065 | 5/1970 | United Kingdom . |
| 1256641 | 12/1971 | United Kingdom . |
| 2026219A | 1/1980 | United Kingdom . |

*Primary Examiner*—Donnie L. Crosland

*Attorney, Agent, or Firm*—Dann, Dorfman, Herrell & Skillman

[57] ABSTRACT

A glazing unit alarm system includes a light transmitting electrically conductive coating which extends over at least most of the area of a glazing panel and forms part of an alarm circuit. Changes in the resistance of the coating, occasioned by breakage or attempted breakage of the glazing panel, trigger an alarm. The alarm system is characterized by the electrically conductive coating being constituted by an emissivity coating, e.g. a low-emissivity coating, for modifying the effect of incident electromagnetic radiation on the glazing panel over different wavelengths.

12 Claims, 10 Drawing Figures

FIG. 5
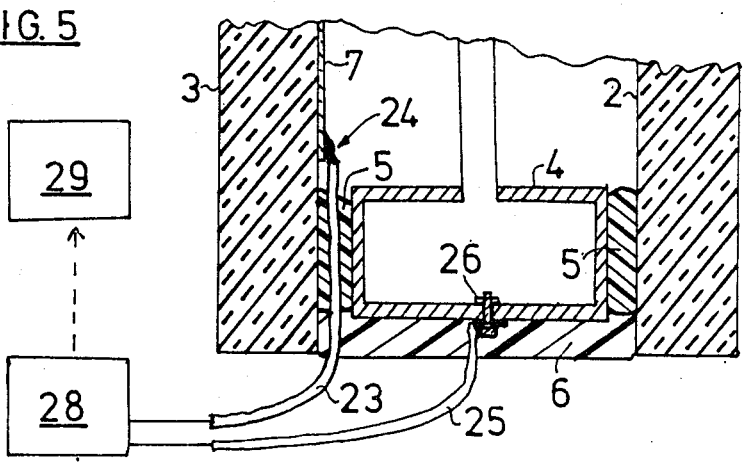
FIG. 6
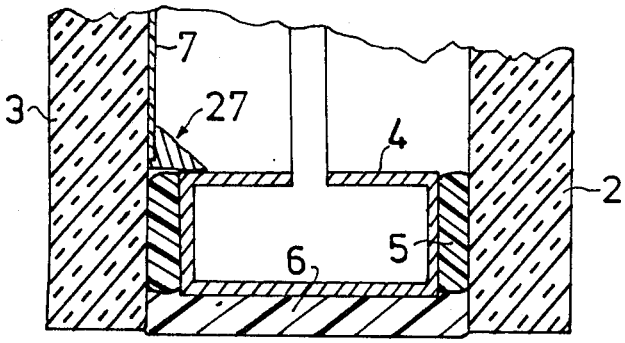
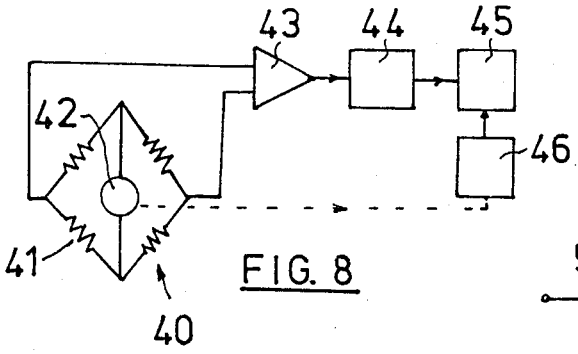
FIG. 8
FIG. 9
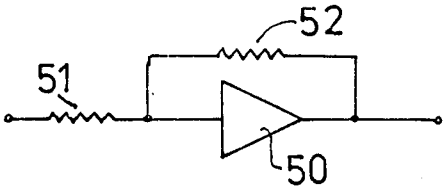

GLAZING UNIT ALARM SYSTEMS

BACKGROUND OF THE INVENTION

1. Field of the Invention

This invention relates to a glazing unit alarm system of the kind comprising an electric alarm circuit and a glazing panel having a light transmitting electrically conductive coating extending across a major face of the panel and forming part of the alarm circuit, the alarm circuit being arranged to be activated on detection of a change in resistance of the electrically conductive coating occasioned by a breakage or an attempted breakage of the glazing panel. The invention is primarily, although not exclusively, intended for application in double glazing units.

2. Description of Related Art

Known glazing unit alarm systems of the kind referred to have previously been disclosed in GB-A-No. 2026219, GB-A-No. 1256641 and U.S. Pat. No. 3,825,918. For example in GB-A-No. 1256641 a chemical deposition/etching technique is disclosed for producing a sinuous pattern for the electrically conductive coating. In U.S. Pat. No. 3,825,918 a metallized layer is applied to a backing film which is subsequently applied to the glass panel. In GB-A-No. 2026219 various examples are given of electrically conductive strips being applied in a precise pattern or of a continuous electrically conductive coating being formed by a thermal decomposition process. However, in each of these known glazing unit alarm systems, an electrically conductive strip or coating is incorporated into a glazing unit for the sole purpose of providing a conductive path as part of an alarm circuit. The provision of these metallized layers greatly increases the complexity of, and cost of producing, such glazing units and heretofore has led to such glazing unit alarm systems of the kind referred to only normally being provided for high security windows where the cost of the window is of secondary importance to its security aspect.

SUMMARY OF THE INVENTION

The present invention seeks to provide a glazing unit alarm system of the kind referred to which makes use of an emissivity glazing panel, e.g. an emissivity or energy glass.

According to one aspect of the present invention a glazing unit alarm system of the kind referred to is characterized in that the electrically conductive coating comprises an emissivity coating as hereinafter defined.

In this specification the term "emissivity coating" means a layer designed to modify the effect of the glazing panel on incident electromagnetic radiation of different wavelengths. In particular the emissivity coating is designed to confer desirable radiation reflecting and/or absorbing properties on the glazing panel. Emissivity coatings may be applied, e.g. by a sputtering or vapour deposition process, to glazing panels, e.g. float glass, either to reflect the majority of short wavelength solar heat radiation incident thereon but to allow the majority of the longer wavelength room heat radiation incident thereon to pass through or to allow the majority of the short wavelength solar radiation incident thereon to pass through but to reflect the majority of the longer wavelength room heat radiation incident thereon. In the United Kingdom where the need is primarily to save heat energy, the latter type of emissivity coating is generally employed and a typical low-emissivity float glass (or "energy glass") having such a coating is produced by Pilkington Brothers Ltd. under the Trade Mark "KAPPAFLOAT". Although the emissivity coating is primarily intended to be directly applied, e.g. sputtered or deposited, onto the glazing material during manufacture, e.g. when the glass is still molten, the invention is also intended to cover an emissivity coating formed on a flexible substrate. In this latter case the film so formed is adhesively applied to the glazing panel. The emissivity coating is typically substantially transparent, but may be tinted or coloured and may only transmit up to 50% of light in the visible spectrum for certain solar control applications. By way of example, typical emissivity coatings comprise coatings of metal oxide, e.g. tin oxide or indium oxide, doped with ions of antimony, arsenic, cadmium, chlorine, fluorine and/or tellarium. Typically such coatings have a thickness of from 10 nm to 100 nm, preferably less than 20 nm.

The present invention makes use of the fact that the emissivity coating is electrically conducting and can be used in an alarm circuit for detecting when a glazing panel to which the coating is applied is subjected to a strain or is broken. Glazing panels can be purchased ready-coated with such emissivity coatings and can subsequently be cut to any desired size. Thus small manufacturers of glazing units can produce glazing unit alarm systems relatively easily and cheaply to any desired size without the need themselves of having to provide special electrically conducting layers on the glazing panels.

The glazing unit alarm system may be arranged to be activated when there is a physical breakage of the emissivity coating so that, in effect, an open circuit, or a substantially infinite resistance is provided in the alarm circuit. Such a physical breakage may occur if the glazing panel is completely smashed during an attempted entry. Alternatively, the alarm system may be activated by a change in the resistance of the coating occasioned by the glazing panel being put under strain or being only partly broken. In this latter case the alarm circuit may be designed only to react to sudden changes in resistance of the emissivity coating and not to react to slowly changing resistance values occasioned by, for example, changes in temperature of the emissivity coating.

According to another aspect of the present invention there is provided a glazing panel having applied, on a major face thereof, an emissivity coating, as hereinbefore defined, and, electrically connected to spaced apart regions of the emissivity coating, spaced apart electrical contact means for connection into an electric alarm circuit.

According to a further aspect of the present invention a multiple, e.g. double glazing unit alarm system comprising two glazing panels arranged face-to-face and separated by spacer means adjacent the peripheries of the glazing panels, the inwardly-facing surface of one of the glazing panels having an emissivity coating, as hereinbefore defined, applied thereon, peripheral sealing means and an alarm circuit including a pair of electric contact means electrically connected to spaced apart regions of the emissivity coating.

Preferably the peripheral sealing means comprises conventional peripheral primary and secondary seals.

Typically the emissivity coating does not extend to the peripheral edges of the glazing panel to which it is applied but terminates inwardly of the spacer means. It is possible, however, for a pair of spaced apart portions of the emissivity coating to extend further, e.g. outwardly of the spacer means, for connection thereto of the electric contact means. Conveniently, however, the electric contact means are connected to said spaced apart regions of the emissivity coating inwardly of the spacer means. In this latter case, flexible conductor means connected to the emissivity coating, may be led through the spacer means, the points of entry or exit of the conductor means to/from the spacer means preferably being sealed. Alternatively, or in addition, parts of the spacer means may act as conductors for connecting the emissivity coating into the alarm circuit.

According to a still further aspect of the present invention a method of manufacturing a multiple, e.g. double, glazing unit alarm system comprises removing from an emissivity coating, as hereinbefore defined, applied over an entire major face of a first glazing panel, a peripheral edge portion of the emissivity coating, connecting a pair of electric contact means to spaced apart regions of the emissivity coating for connection of the latter into an alarm circuit, arranging peripheral spacer means between the first glazing panel and a second glazing panel so that the panels are positioned in face-to-face relationship and peripherally sealing the spaced-apart first and second glazing panels, the emissivity coating being positioned internally in the glazing unit. In a double glazing unit the first glazing panel may form the outer pane, but preferably forms the inner pane, of an installed unit.

BRIEF DESCRIPTION OF THE DRAWINGS

Embodiments of the invention will now be described, by way of example, with reference to the accompanying drawings, in which:

FIGS. 5 and 6 are enlarged sectional views of diagonally opposite corners of an alternative method of connecting the emissivity coating into an alarm circuit, FIG. 8 is a schematic block diagram of an alarm circuit for an alarm system according to the invention, FIG. 9 is a further schematic diagram illustrating a different resistance sensing technique.

DESCRIPTION OF THE PREFERRED EMBODIMENTS

Figure 1:
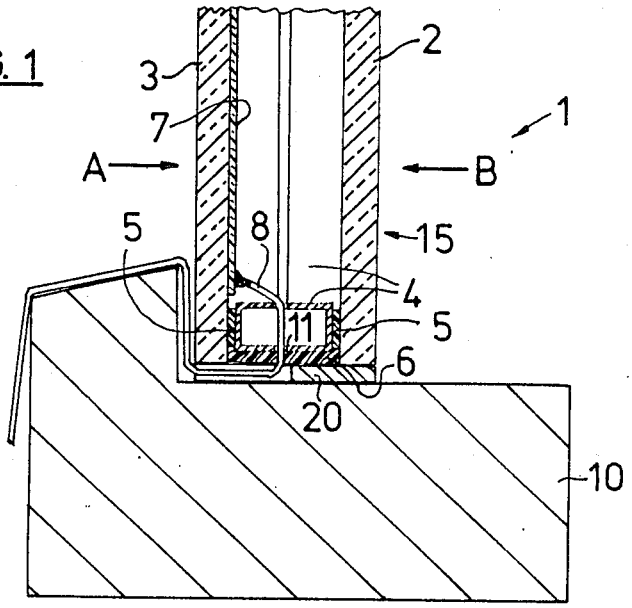
FIG. 1 is a partial sectional view of a double glazing unit alarm system according to the invention positioned in a window frame.
Figure 2:
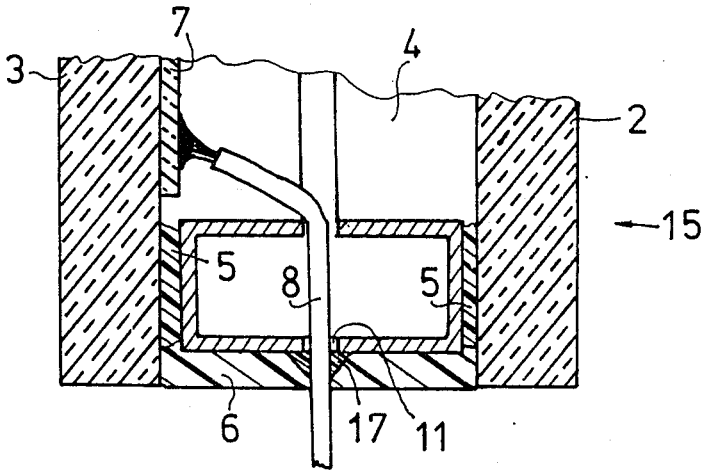
FIG. 2 is an enlarged sectional view of part of the system shown in FIG. 1.

FIG. 1 shows a double glazing window alarm system, generally designated by the reference numeral 1, comprising a double glazing unit 15 mounted in a window frame 10. The unit 15 comprises glazing panels 2 and 3 arranged in face-to-face relationship and having peripheral spacing means 4 therebetween to space the panels 2 and 3 the desired distance apart. The spacing means 4 may be of any known form but typically comprises metallic, hollow spacer elements containing a desiccant and arranged as a rectangular frame. Primary seals 5 (see FIG. 2), e.g. of polyisobutylene, are arranged between the spacing means 4 and the glazing panels 2 and 3 and a conventional secondary seal 6, e.g. of silicone, is provided around the entire periphery of the spacing means 4.

The glazing panel 2 may be of any known glazing material but is typically made of glass and may be clear, tinted and/or figured. The glazing panel 3, on the other hand, is a special type of glazing panel known as emissivity glass (or energy glass). In particular the panel 3 has an emissivity coating 7, as hereinbefore defined, formed on its inwardly facing surface which serves to allow the majority of the short wavelength solar radiation incident thereon to pass through the glazing unit 15 in the direction indicated by the arrow A but to reflect the majority of the longer wavelength room heat incident on the glazing unit as indicated by the arrow B. Such energy glass is readily available in the United Kingdom, for example under the Trade Names of "KAPPAFLOAT" (Pilkington Brothers Ltd.) or "IPLUS" (Interpane Glas AG).

In the glazing unit 15 the emissivity coating 7 has been removed, e.g. by burning off or grinding, around the entire periphery of the glazing panel 3 to a depth of approximately 12 mm—i.e. just inwardly of the spacing means 4—and a pair of electrical wires 8 and 9 (see FIG. 4) are electrically connected to spaced apart regions of the emissivity coating 4—e.g. adjacent opposite corners or sides of the glazing unit 15. The electrical conductors 8 and 9 pass through openings 11 (which may be fitted with grommets—not shown) in the spacing means 4 which openings are sealed, e.g. with butyl material, to provide vapour seals 17. The electrical conductors 8 and 9 form part of an electric alarm circuit and provide the means for connecting the emissivity coating 7 into the alarm circuit.

In the simplest form the alarm circuit is powered by a replaceable small domestic battery, typically 9v and having a life in excess of 12 months. The alarm circuit is arranged to be activated when there is a breakage in the conduction path between the conductors 8 and 9 through the emissivity layer 4 occasioned by breakage of the glazing panel 3. The alarm circuit may, however, be more complex to enable the sensing of sudden changes in the resistance of the metallic emissivity coating occasioned by the glazing panel 3 being put under strain and/or being partly broken.

By way of example, FIG. 8 is a block diagram of a typical alarm circuit for use in the alarm system. In the illustrated circuit a resistance bridge 40 is provided for detecting changes in the resistance of the emissivity coating (represented by the resistance 41) and a power supply 42, e.g. a d.c. power supply, supplies power to the bridge. Signals from the bridge 40 are supplied via an amplifier 43 to a threshold detector 44. In the null balance of the bridge 40 is outside a predetermined limit the threshold detector 44 supplies a signal to alarm 45. The alarm circuit may also include a circuit 46 for checking the charge of the battery and sounding the alarm 45, e.g. intermittently over a long period, when it needs to be replaced.

A resistance bridge is not, of course, the only way of detecting a change in the resistance of the emissivity coating. FIG. 9 shows another simple technique employing an operational amplifier 50 having a resistor 51 connected to its input and a further resistor 52 connected across the amplifier. Since the output voltage from the operational amplifier 50 is dependent on the resistances of the resistors 51 and 52, the circuit can be used as a resistance detector if one of the resistors 51, 52 comprises the emissivity coating.

Figure 3:
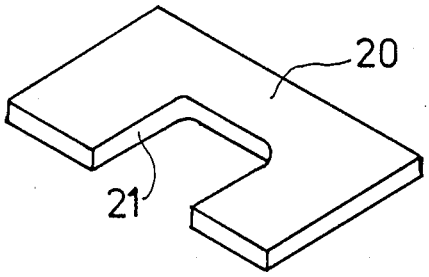
FIG. 3 is a perspective view of a blocking piece on which the glazing unit shown in FIG. 1 rests.

In FIG. 1 the glazing unit 15 is shown resting on a block 20 in the window frame 10. The block 20 (see FIG. 3) has a recess 21 therein in which the conductors 8 and 9 are received to prevent the weight of the unit 15 bearing directly on them. Alternatively the conductors may exit through the frame, e.g. downwardly or sideways at the bottom corner.

Figure 4:
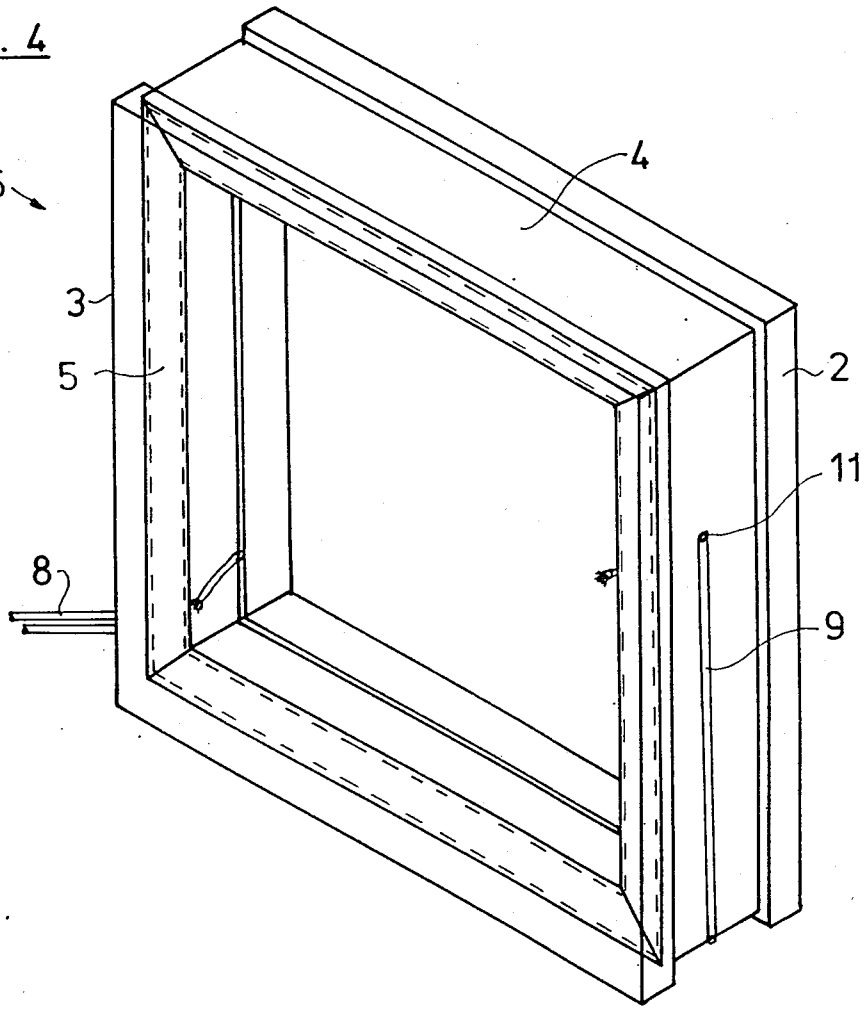
FIG. 4 is a perspective view of a partly assembled double glazing unit alarm system prior to the provision of a secondary seal.

FIG. 4 shows the glazing unit 15 partly assembled prior to the provision of the secondary seal 6. The spaced apart points of connection of the conductors 8 and 9 to the metallic emissivity coating 4 can, however, be clearly seen. The conductor 9, after passing through the opening 11 in the spacing means 4 is arranged around the periphery of the spacing means until it reaches the point of exit of the other conductor 8 through the other opening 11 in the spacing means. Typically each conductor 8, 9 has a length of approximately 400 mm exiting from the glazing unit 15 for connection into the alarm circuit. In this condition the glazing unit 15 is ready for application of the secondary seal.

FIGS. 5 and 6 show an alternative method of connecting the emissivity coating 7 into an alarm circuit (where possible the same reference numerals have been employed to designate parts similar to the embodiment shown in FIGS. 1 to 4). In particular a thin copper wire 23 (see FIG. 5) is embedded in the primary and secondary seals 5 and 6 and has a flattened end which is connected to the emissivity coating 7 by means of an electrically conductive adhesive 24. At the same corner of the glazing unit, a further copper wire 25 is mechanically and electrically connected to the spacer 4, which is metallic and electrically conducting, by screw attachment means 26. At the diagonally opposite corner of the glazing unit (see FIG. 6), the spacer 4 is electrically connected to a corner portion of the emissivity coating 7 by means of an electrically conductive adjesive connection 27. In this emobidment of glazing unit, it is of course essential for the spacer 4 to provide a continuous electrically conducting path between the screw attachment means 26 and the adhesive connection 27 and this can be achieved by soldering or welding the spacer "bars" at each corner to provide a continuous spacer frame. In the embodiment shown in FIGS. 5 and 6, the wires 23 and 25 are connected to an alarm box 28 which may incorporate a transmitter for transmitting an alarm signal to a receiving unit 29 spaced at a remote location from the alarm box 28 which may, for example, be plugged into a mains circuit.

Other arrangements for the connection of the emissivity ocating 7 into the alarm circuit are also possible. For example the conductors 8 and 9 may be positioned inside the spacing means 4 before exiting to the outside at a common exit point. Also it is possible, although not preferable, for a pair of spaced apart contact portions of the emissivity coating to extend to the peripheral edge of the glazing panel outwardly of the spacing means for connection to a pair of conductors. In this latter case it is essential to incorporate primary seals as well as a secondary seal to ensure that the spacing means is electrically insulated from the emissivity coating. However, this is not a preferred construction because of possible oxidation of the metallic emissivity coating into the inside of the unit which would affect the heat insulation performance of the glazing unit. Furthermore it is more difficult to obtain adequate sealing of the primary and secondary seals on the emissivity coating as opposed to directly onto the uncoated glass, causing possible eventual failure of the glazing unit at the regions where the emissivity coating extends to the peripheral edge of the unit.

In use of the double glazing window alarm system, a number of glazing units 15 may be connected into a single alarm circuit in a building, e.g. a house, to be protected. More conveniently, however, each glazing unit is connected to its own alarm circuit positioned close to the window to be protected.

Figure 7:
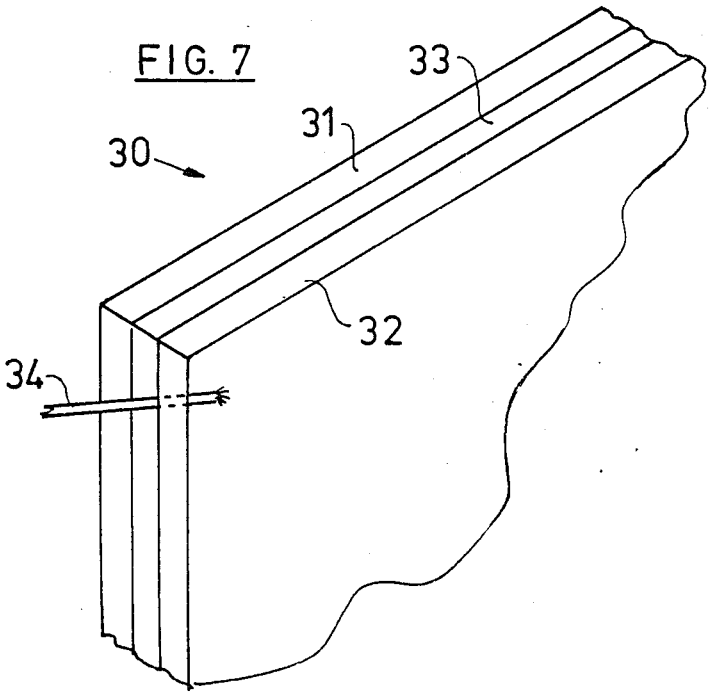
FIG. 7 is a perspective view of part of a laminated glazing unit alarm system according to the invention.

Although primarily intended for application to double glazing unit alarm systems the invention also finds application in triple or other multiple glazing units and/or in laminated glazing units. For example in FIG. 7 there is shown a laminated glazing unit 30 having a first glazing panel 31, e.g. of glass, a second glazing panel 32 provided with an emissivity coating (not shown) as hereinbefore defined, and an intermediate laminating material 33 e.g. polyvinylbutyrate or resin material. Contact wires 34 (only one of which is shown in FIG. 7) are attached to spaced apart regions, e.g. opposite corners, of the glazing unit 30. These wires are fixed in position during the actual laminating process to ensure a good electrical and mechanical bond. The wires 34 are connected into a alarm circuit (not shown) similar to the one described with respect to the double glazing unit 15.

Figure 10:
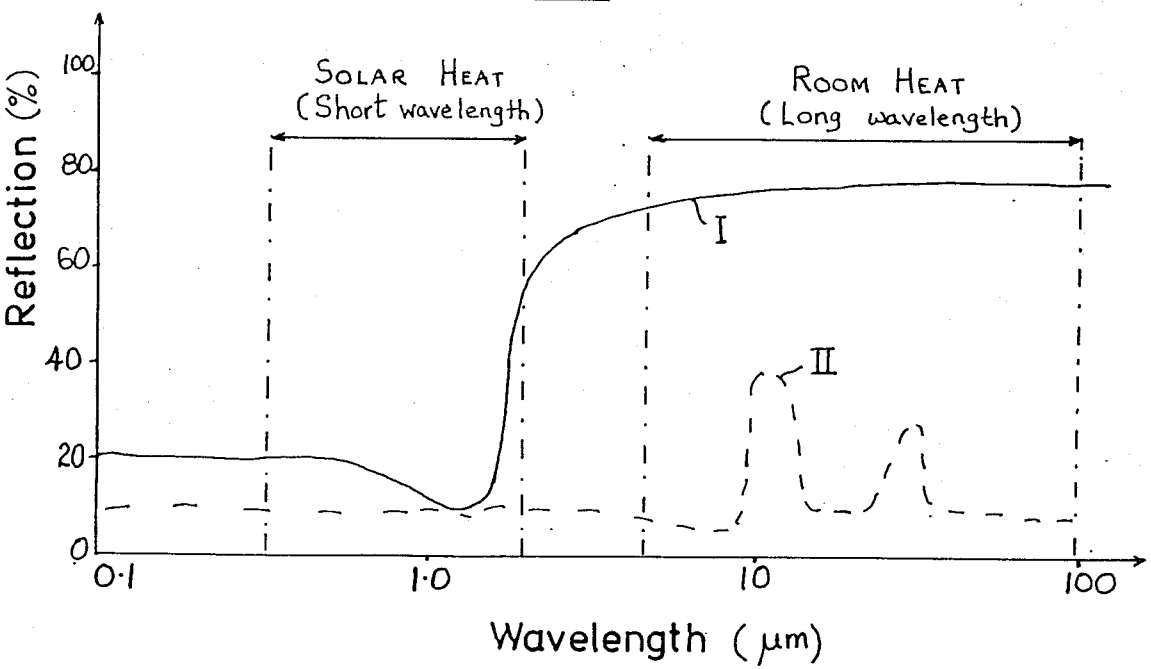
FIG. 10 shows reflection curves for conventional float glass and float glass having an emissivity coating thereon.

The invention is primarily related to, and has been described particularly with reference to, low-emissivity coatings designed to reflect room radiation incident thereon and to allow sunlight heat radiation incident thereon to pass therethrough. In this respect, FIG. 10 shows a typical reflection curve for glass, e.g. "KAPPAFLOAT" (Trade Mark) glass, having a low-emissivity coating thereon. The reflection curve shows how the reflection characteristic (curve I) of the coated glass is modified in comparison with the reflection characteristic (curve II) of conventional float glass not provided with an emissivity coating.

Of course other types of emissivity coating may be employed in certain applications or locations. For example in hot climates, an emissivity or solar control coating may be required to reflect incident sunlight heat radiation and to allow room radiation incident thereon to pass therethrough. In either case the emissivity coating is primarily for reflecting room or sunlight radiation and the present invention resides in the recognition that this emissivity coating can be used as an electrically conductive coating in a burglar alarm system for a glazing unit. The emissivity coating is preferably applied during the manufacture of the glazing material, e.g. by sputtering or vacuum deposition processes, in order to provide a layer of high and uniform optical quality. Such pre-coated glazing material is readily available to glazing manufacturers for use in manufacturing glazing unit alarm systems according to the invention. The invention is also intended to embrace emissivity coatings applied on a flexible substrate, the solar control film so formed being adhered to the glazing panel.

Many modificiations and variations to the described invention will be apparent to those skilled in the art and it is intended that, within the scope of the ensuing claims, the invention may be practised otherwise than as specifically described herein.

I claim:

1. A glazing unit alarm system comprising a glazing panel and electric alarm means including a light transmitting electrically conductive coating extending over at least most of the area of the glazing panel and detection means for detecting a change in resistance of the electrically conductive coating occasioned by a breakage or an attempted breakage of the glazing panel, wherein the electrically conductive coating comprises an emissivity coating which reflects the majority of incident heat radiation having wavelengths in a first wavelength band and which transmits the majority of incident heat radiation having wavelengths in a second wavelength band, the first and second wavelength bands being non-overlapping and each lying in the infra-red region of the electromagnetic spectrum, one of the wavelength bands containing shorter wavelength solar heat radiation and the other wavelength band containing longer wavelength room heat radiation.

2. A glazing unit alarm system according to claim 1, wherein the emissivity coating is a low-emissivity coating.

3. A glazing unit alarm system according to claim 1, wherein the alarm circuit means further includes first and second wires electrically connected by first and second connection means, respectively, to spaced apart regions of the emissivity coating.

4. A glazing unit alarm system according to claim 3, where each of said first and second connection means comprises electrically conductive adhesive.

5. A multiple glazing unit alarm system comprising a multiple glazing unit having first and second glazing panels arranged face-to-face and separated by spacer means adjacent the peripheries of the two glazing panels and sealing means for sealing peripheral edge regions of the glazing unit and electric alarm circuit means including a light transmitting electrically conductive coating extending over at least most of the area of the first glazing panel and detection means for detecting a change in resistance of the electrically conductive coating occasioned by a breakage or an attempted breakage of the multiple glazing unit, wherein the electrically conductive coating comprises an emissivity coating which reflects the majority of incident heat radiation having wavelengths in a first wavelength band and which transmits the majority of incident heat radiation having wavelengths in a second wavelength band, the first and second wavelength bands being non-overlapping and each lying in the infra-red region of the electromagnetic spectrum, one of the wavelength bands containing shorter wavelength solar heat radiation and the other wavelength band containing longer wavelength room heat radiation.

6. An alarm system according to claim 5, wherein the sealing means comprise a primary seal between the spacer means and each of the first and second panels and a secondary seal peripherally surrounding the spacer means.

7. An alarm system according to claim 5, wherein the spacer means is metallic and wherein the alarm circuit further includes first wire means directly connected to a first region of the emissivity coating adjacent a first peripheral region of the glazing unit, second wire means mechanically and electrically connected to the spacer means and bridging means for electrically connecting the spacer means to a second region of the emissivity coating spaced from said first region.

8. An alarm system according to claim 7, wherein the bridging means comprises electrically conductive adhesive.

9. An alarm system according to claim 7, wherein the glazing unit is rectangular and said first and second regions are adjacent diagonally opposite corners of the glazing unit.

10. An alarm system according to claim 5, wherein the emissivity coating is on an inner face of the first glazing panel.

11. A glazing unit alarm system according to claim 1 including framing means extending around the periphery of the glazing panel, the said emissivity coating terminating in spaced relation to said framing means to provide a peripheral margin extending about the periphery of said glazing panel which is free of said electrically conductive emissivity coating.

12. A multiple glazing unit alarm system according to claim 5 wherein said spacer means extends about the periphery of the glazing panels, said electrically conductive coating terminating adjacent the periphery of the first glazing panel in spaced relation to said spacer means, so as to provide on said first glazing panel a peripheral edge region free of said electrically conductive emissivity coating.

* * * * *